US010646020B2

(12) United States Patent
Jeong et al.

(10) Patent No.: US 10,646,020 B2
(45) Date of Patent: May 12, 2020

(54) FINGER INSERTION MASCARA CONTAINER HAVING ECCENTRICALLY FORMED BRUSH ROD

(71) Applicant: AMOREPACIFIC CORPORATION, Seoul (KR)

(72) Inventors: Hae Won Jeong, Seoul (KR); Hyun Woo Roh, Seoul (KR); Eun Sil Han, Seoul (KR)

(73) Assignee: AMOREPACIFIC CORPORATION, Seoul (KR)

( * ) Notice: Subject to any disclaimer, the term of this patent is extended or adjusted under 35 U.S.C. 154(b) by 257 days.

(21) Appl. No.: 15/738,548

(22) PCT Filed: Jul. 4, 2016

(86) PCT No.: PCT/KR2016/007206
§ 371 (c)(1),
(2) Date: Dec. 20, 2017

(87) PCT Pub. No.: WO2017/007207
PCT Pub. Date: Jan. 12, 2017

(65) Prior Publication Data

US 2018/0186514 A1 Jul. 5, 2018

(30) Foreign Application Priority Data

Jul. 6, 2015 (KR) ..... 10-2015-0096128

(51) Int. Cl.
*A45D 34/04* (2006.01)
*A45D 40/26* (2006.01)

(52) U.S. Cl.
CPC ..... *A45D 40/264* (2013.01); *A45D 34/042* (2013.01); *A45D 34/043* (2013.01);
(Continued)

(58) Field of Classification Search
CPC .... A45D 34/04; A45D 34/046; A45D 34/045; A45D 34/042; A45D 40/262;
(Continued)

(56) References Cited

U.S. PATENT DOCUMENTS 4,213,472 A 7/1980 L'Oreal
6,024,507 A 2/2000 Joulia
(Continued)

FOREIGN PATENT DOCUMENTS

JP 2005-111959 A 4/2005
JP 4254523 B2 4/2009
(Continued)

*Primary Examiner* — David J Walczak
(74) *Attorney, Agent, or Firm* — Heedong Chae; Lucem, PC

(57) ABSTRACT

The present invention includes a finger-insertion mascara container having an eccentrically formed brush rod, the container having a structure in which: a packing is coupled to an upper opening of a container body for accommodating a mascara liquid; a wiper is coupled to the lower part of the packing and has an eccentric brush rod insertion hole formed to be eccentrically lopsided; a finger insertion member is inserted into the wiper; forms a finger insertion space, and has an eccentric brush rod coupling part formed to be eccentrically lopsided at the lower side thereof; and a brush rod having a brush is coupled to the eccentric brush rod coupling part.

15 Claims, 8 Drawing Sheets

(52) U.S. Cl.
CPC ..... *A45D 34/045* (2013.01); *A45D 34/046* (2013.01); *A45D 40/262* (2013.01); *A45D 40/265* (2013.01); *A45D 40/267* (2013.01)

(58) Field of Classification Search
CPC .. A45D 40/264; A45D 40/265; A45D 40/267; B65D 25/03; B65D 41/04; B65D 51/32; B65D 53/02
See application file for complete search history.

(56) References Cited

U.S. PATENT DOCUMENTS

| | | | | |
|---|---|---|---|---|
| 6,997,321 | B2 | 2/2006 | Young | |
| D615,304 | S | 5/2010 | L'Oreal | |
| 8,523,473 | B2 * | 9/2013 | Kim | A45D 34/043 401/126 |
| 8,851,775 | B2 * | 10/2014 | Jacob | A45D 40/267 401/129 |
| 2009/0028627 | A1 | 1/2009 | L'Oreal | |
| 2018/0168319 | A1 * | 6/2018 | Jeong | A45D 40/18 |
| 2019/0350341 | A1 * | 11/2019 | Cho | A45D 40/18 |
| 2020/0022481 | A1 * | 1/2020 | Cho | A45D 40/267 |

FOREIGN PATENT DOCUMENTS

| | | | |
|---|---|---|---|
| KR | 20-2011-0005581 | U | 6/2011 |
| KR | 20-0459829 | Y1 | 4/2012 |

* cited by examiner

Prior Art

Prior Art

FINGER INSERTION MASCARA CONTAINER HAVING ECCENTRICALLY FORMED BRUSH ROD

CROSS-REFERENCE TO RELATED APPLICATION

This application claims the benefit of Korean application No. 10-2015-0096128, filed on Jul. 6, 2015 with the Korean Intellectual Property Office, the disclosure of which is incorporated herein by reference.

TECHNICAL FIELD

The present invention relates to a finger-insertion mascara container having an eccentrically formed brush rod, and more particularly, to a finger-insertion mascara container having an eccentrically formed brush rod, in which the finger-insertion mascara container has a structure that: a packing is coupled to an upper opening of a container body for accommodating a mascara liquid; a wiper having an eccentric brush rod insertion hole, which is eccentrically biased, is coupled to a lower part of the packing; a finger insertion member formed with a finger insertion space and provided at a lower side thereof with an eccentric brush rod coupling part which is eccentrically biased is inserted into the wiper; and a brush rod having a brush is coupled to the eccentric brush rod coupling part, wherein a user takes out the finger insertion member by inserting a finger into the finger insertion space so as to put makeup on the eyelashes with the brush of the eccentrically formed brush rod, thereby preventing the mascara brush rod from coming into contact with the face and disturbing makeup, as in the related art, and preventing the mascara liquid on the brush rod from staining the sides of the eyes or the nose.

BACKGROUND ART

Color cosmetics, which are used to beautifully adorn the skin of a user by making the appearance beautiful, are classified into a base makeup used for making a skin color uniform and covering a defect, and a point makeup used for partially enhancing a three-dimensional effect of a lip, eyes, or nails. The base makeup includes a makeup base, a foundation, and a powder, and the point makeup includes a lipstick, an eye liner, and mascara.

The mascara is a cosmetic product which allows eyelashes to look thick and long so that it can give a clear impression, and a brush is used to apply a cosmetic material on the eyelashes.

In general, the mascara includes a brush integrally formed on a lid of a container containing a mascara cosmetic material. When a user opens the lid to use the cosmetic material, the contents are put on the brush so that the contents put on the brush may be applied to eyelashes.

However, because the above conventional mascara container has a brush elongated downward in a straight line from a center of the lid, an edge of the lid touches a face of the user when the user puts makeup on the lashes at various angles, thus the user rarely put makeup on the eyelashes elaborately, and the mascara liquid on the brush rod is stained on the face, especially on sides of the eyes or on the nose.

To solve the problems as the above, as shown in FIG. 1, the applicant of the present invention has disclosed Korean Utility Model Publication No. 20-2011-0009608, in which a brush rod having an insert groove is coupled to the inside of the container lid, a multi-joint arm 1 capable of changing an angle by external force is coupled to the insert groove, and a brush base having brush bristles is coupled to an outer periphery of the multi-joint arm 1, such that the user can easily put makeup on the eyelashes at various angles by changing the angle of the brush according to a manipulation taste or an eyelash curvature in the process of withdrawing the brush from the mascara container.

The related art has solved the problem that the lid touches the face or the mascara liquid on the brush rod comes into contact with the face when the user puts makeup on the eyelashes at various angles, by changing the angle of the brush. However, because the brush is bent at a predetermined angle, the bent brush stabs an eyelid when the user puts makeup on the lashes while rotating the mascara brush.

To solve the problems as the above, as shown in FIG. 2, the applicant of the present invention has disclosed Korean Utility Model Registration No. 20-0459829, which relates to a makeup application tool for applying a makeup cosmetic material by fitting a finger in the tool, in which the makeup application tool including a thimble inserted therein with a finger and formed of a material having elastic restoring force, a brush rod extending from the thimble, and an application tip formed at an end of the brush rod, wherein the thimble is formed with an elastic support piece 2 having a coil spring shape extending in a direction to insert a finger, thus the elastic support piece 2 wraps and fix the finger when the finger is put in the thimble, so that the makeup can be performed at various angles by moving only the finger.

The above related art prevents the eyelashes from being stabbed upon eyelash makeup, however, because the brush rod extending from the lower side of the thimble is positioned at a center of the thimble, the thimble comes into contact with the face upon on makeup, thus it is still inconvenient to put makeup.

In addition, because the finger is fixed only by the elastic support piece 2 formed on the thimble and having the coil spring shape, the finger is rarely fixed firmly and an application member is shaken, thus the elaborate makeup cannot be performed.

DISCLOSURE

Technical Problem

To solve the above problems, the present invention provides a finger-insertion mascara container having an eccentrically formed brush rod, in which the finger-insertion mascara container has a structure that: a packing is coupled to an upper opening of a container body for accommodating a mascara liquid; a wiper having an eccentric brush rod insertion hole which is eccentrically biased is coupled to a lower part of the packing; a finger insertion member is inserted into the wiper, forms a finger insertion space, and has an eccentric brush rod coupling part formed to be eccentrically biased in one direction at a lower side thereof; and a brush rod having a brush is coupled to the eccentric brush rod coupling part, wherein the user takes out the finger insertion member by inserting a finger into the finger insertion space so as to put makeup on the eyelashes with the brush of the eccentrically formed brush rod, thereby preventing the mascara brush rod from coming into contact with the face and disturbing makeup, as in the prior art, and preventing the mascara liquid on the brush rod from staining the sides of the eyes or the nose.

In addition, the present invention provides a finger-insertion mascara container having an eccentrically formed brush rod, in which the mascara is used by inserting the finger into the finger insertion space formed in the finger insertion member, thereby facilitating putting makeup on the eyelashes by using only the finger without holding a separate lid in a hand, and preventing the brush from being dropped due to the carelessness of the user upon putting makeup on the eyelashes.

In addition, the present invention provides a finger-insertion mascara container having an eccentrically formed brush rod, in which a plurality of elastic slit portions are formed between the finger retaining portions extending from an upper portion of the finger insertion member, so that the fingers can be easily inserted regardless of the thickness of the fingers when fingers of users having fingers different in thickness from each other are inserted into the finger insertion space, and the finger retaining portion, which is opened when the finger is inserted, is elastically returned and fix the finger, so that the user can elaborately put makeup on the eyelashes without shaking upon makeup.

Technical Solution

The present invention provides a finger-insertion mascara container having an eccentrically formed brush rod, which includes: a container body (10) accommodated therein with a mascara liquid and formed in an upper portion thereof with an opening (11);

a wiper (30) formed in a lower side thereof with an eccentric brush rod insertion hole (34) and mounted on the opening (11) of the container body (10) to sweep a cosmetic material;

a finger insertion member (40) inserted into the wiper (30), formed therein with a finger insertion space (41), and provided at a lower side thereof with an eccentric brush rod coupling part (43); and a brush rod 50 coupled to the eccentric brush rod coupling part (43) of the finger insertion member (40), and provided on a lower side thereof with a mascara brush (51), in which the eccentric brush rod insertion hole (34) is formed in the lower side of the wiper (30) while being biased in one direction, and the eccentric brush rod coupling part (43) is formed at the lower side of the finger insertion member (40) while being biased in one direction so as to be inserted into the eccentric brush rod insertion hole (34).

In addition, a packing (20) may be further coupled between the opening (11) of the container body (10) and the wiper (30).

In addition, the wiper (30) may be provided on an outer peripheral surface thereof with a corrugated tube (31).

In addition, the wiper (30) may be formed on a lower outer peripheral surface thereof with a counter-flow prevention protrusion wheel (32) for preventing a counter-flow of the mascara liquid.

In addition, the finger insertion member (40) may be provided on an inner peripheral surface thereof with an anti-slip protrusion (42).

In addition, a finger retaining portion (44) may extend from an upper portion of the finger insertion member (40), and an elastic slit portion (45) may be formed between the finger retaining portion (44).

In addition, a container lid (60) may be further coupled to an upper portion of the container body (10).

In addition, the container lid (60) may be formed on an inner surface thereof with a pressing protrusion wheel (61).

Advantageous Effects

The above finger-insertion mascara container having the eccentrically formed brush rod according to the present invention has a structure that; a packing is coupled to an upper opening of a container body for accommodating a mascara liquid; a wiper is coupled to a lower part of the packing and has an eccentric brush rod insertion hole formed to be eccentrically biased in one direction; a finger insertion member is inserted into the wiper, forms a finger insertion space, and has an eccentric brush rod coupling part formed to be eccentrically biased in one direction at a lower side thereof; and a brush rod having a brush is coupled to the eccentric brush rod coupling part, wherein the user takes out the finger insertion member by inserting a finger into the finger insertion space so as to put makeup on the eyelashes with the brush of the eccentrically formed brush rod, thereby preventing the mascara brush rod from coming into contact with the face and disturbing makeup, as in the prior art, and preventing the mascara liquid on the brush rod from staining the sides of the eyes or the nose.

In addition, the present invention provides a finger-insertion mascara container having an eccentrically formed brush rod, in which the mascara is used by inserting the finger into the finger insertion space formed in the finger insertion member, so that putting makeup on the eyelashes can be easily performed by using only the finger without holding a separate lid in a hand, and the brush can be prevented from being dropped due to the carelessness of the user upon putting makeup on the eyelashes.

In addition, the present invention provides a finger-insertion mascara container having an eccentrically formed brush rod, in which a plurality of elastic slit portions are formed between the finger retaining portions extending from an upper portion of the finger insertion member, so that the fingers can be easily inserted regardless of the thickness of the fingers when fingers of users having fingers different in thickness from each other are inserted into the finger insertion space, and the finger retaining portion, which is opened when the finger is inserted, is elastically returned and fix the finger, so that the user can elaborately put makeup on the eyelashes without shaking upon makeup.

BEST MODE

[Mode for Invention]

Embodiments of a finger-insertion mascara container having an eccentrically formed brush rod according to the present invention will be described with reference to the accompanying drawings.

Figure 1:
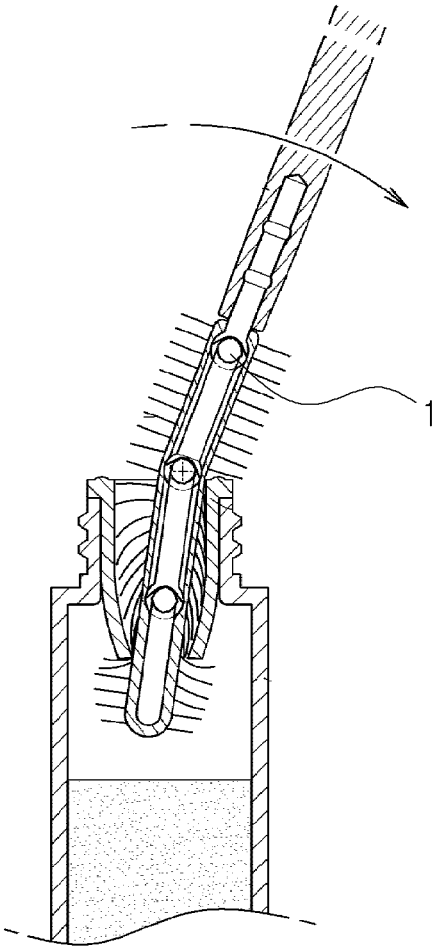
FIG. 1 is a sectional view showing a state of bending a conventional brush.
Figure 2:
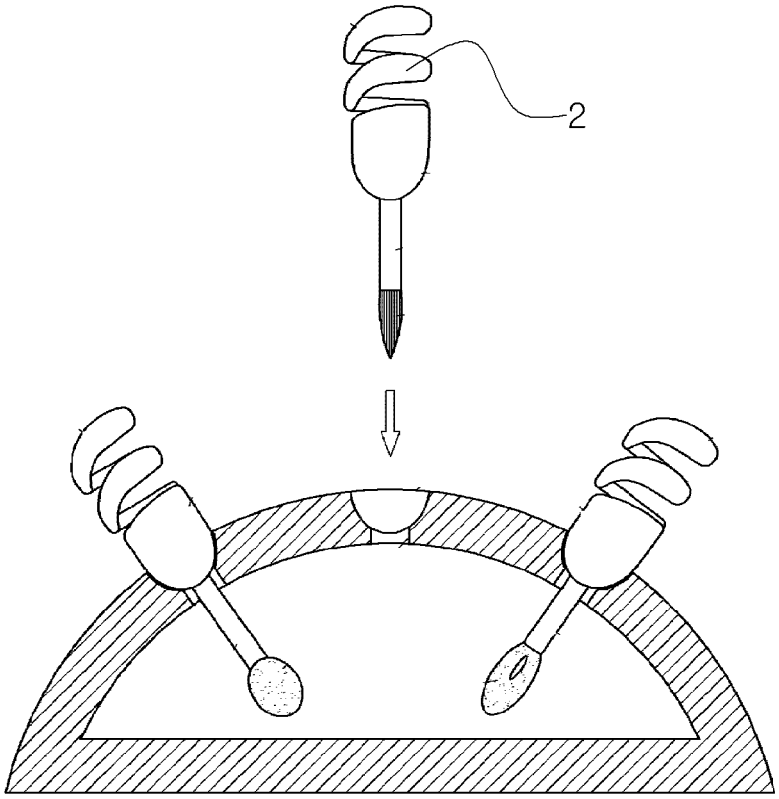
FIG. 2 is a sectional view of another conventional brush.
Figure 3:
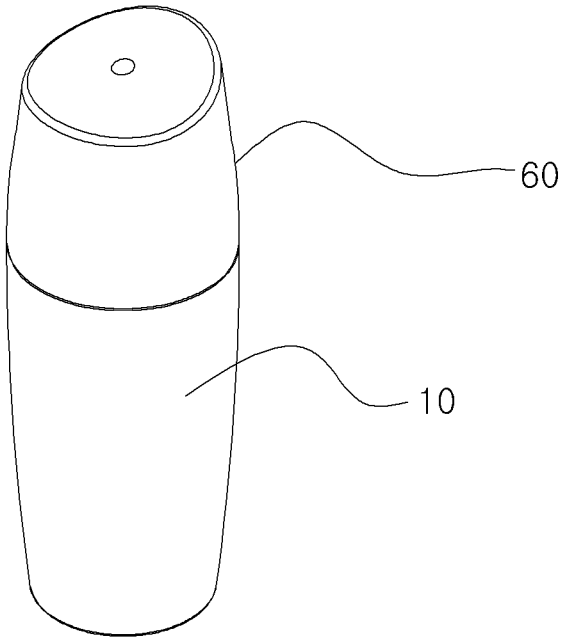
FIG. 3 is a perspective view showing a finger-insertion mascara container having an eccentrically formed brush rod according to an embodiment of the present invention.
Figure 4:
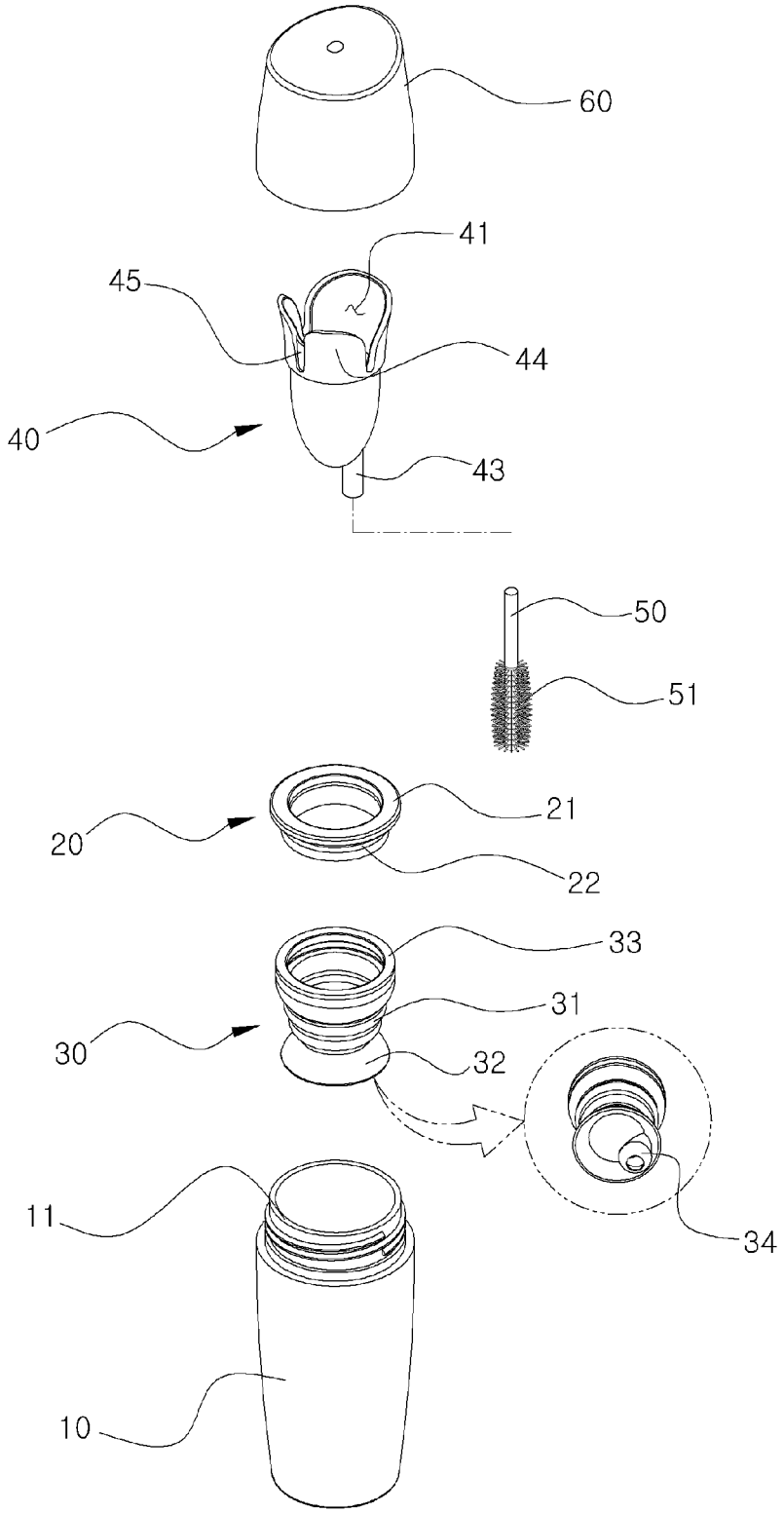
FIG. 4 is an exploded perspective view showing a finger-insertion mascara container having an eccentrically formed brush rod according to an embodiment of the present invention.
Figure 5:
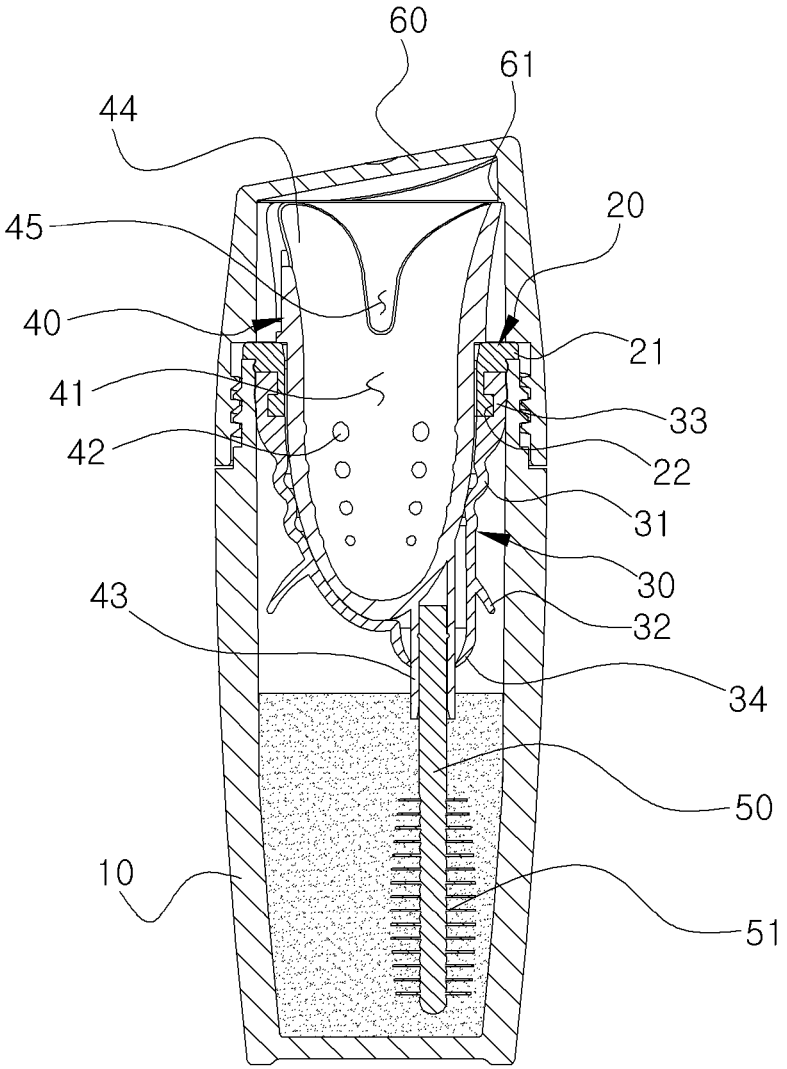
FIG. 5 is a sectional view showing a finger-insertion mascara container having an eccentrically formed brush rod according to an embodiment of the present invention.
Figure 6:
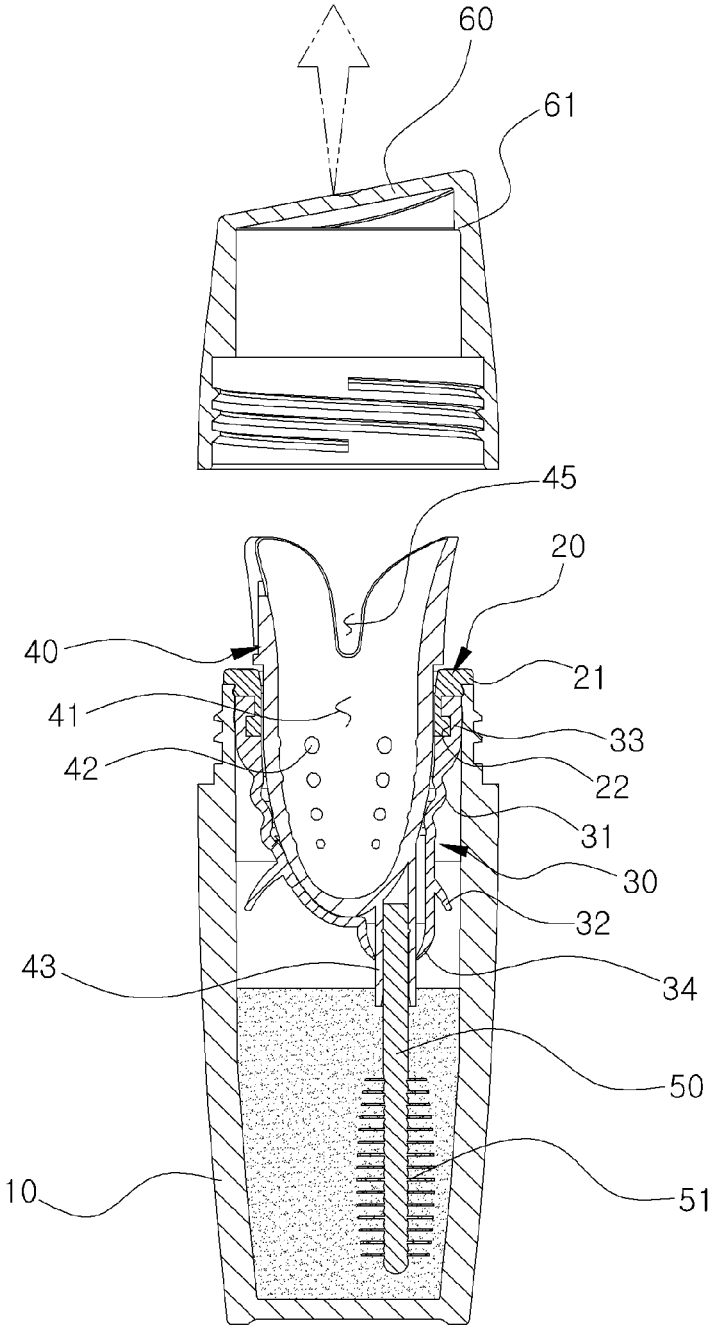
FIG. 6 is a sectional view showing a state of separating a container lid of a finger-insertion mascara container having an eccentrically formed brush rod according to an embodiment of the present invention.
Figure 7:
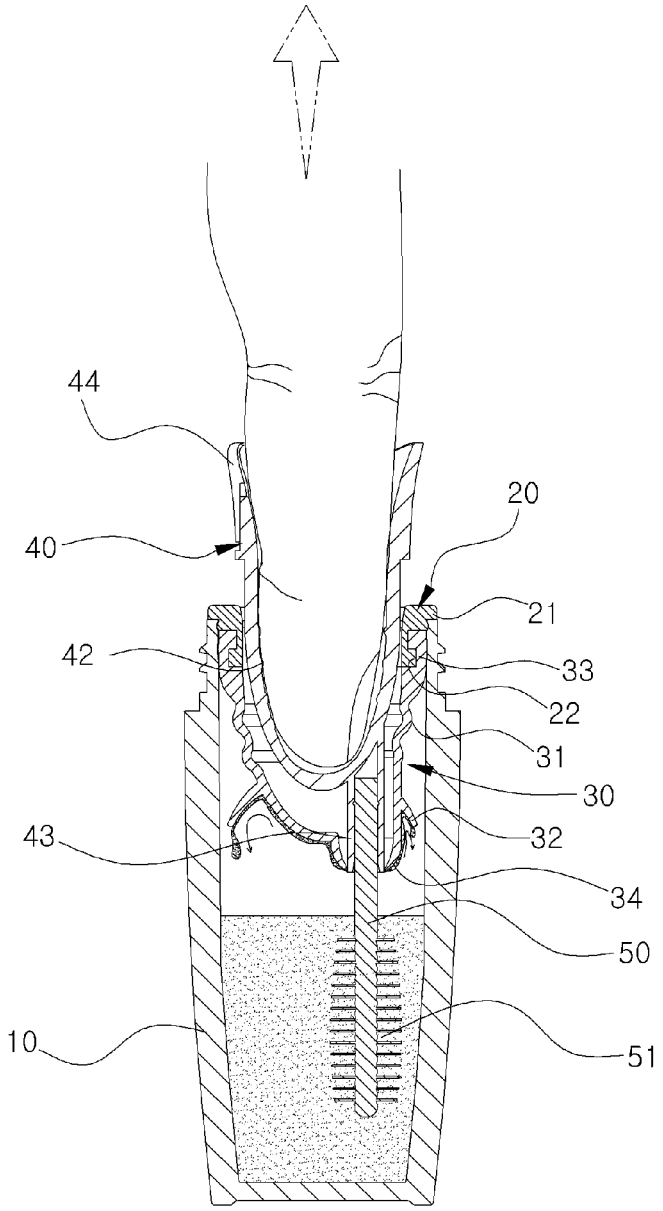
FIG. 7 is a sectional view showing a state of separating a finger insertion member by inserting a finger into a finger-insertion mascara container having an eccentrically formed brush rod according to an embodiment of the present invention.
Figure 8:
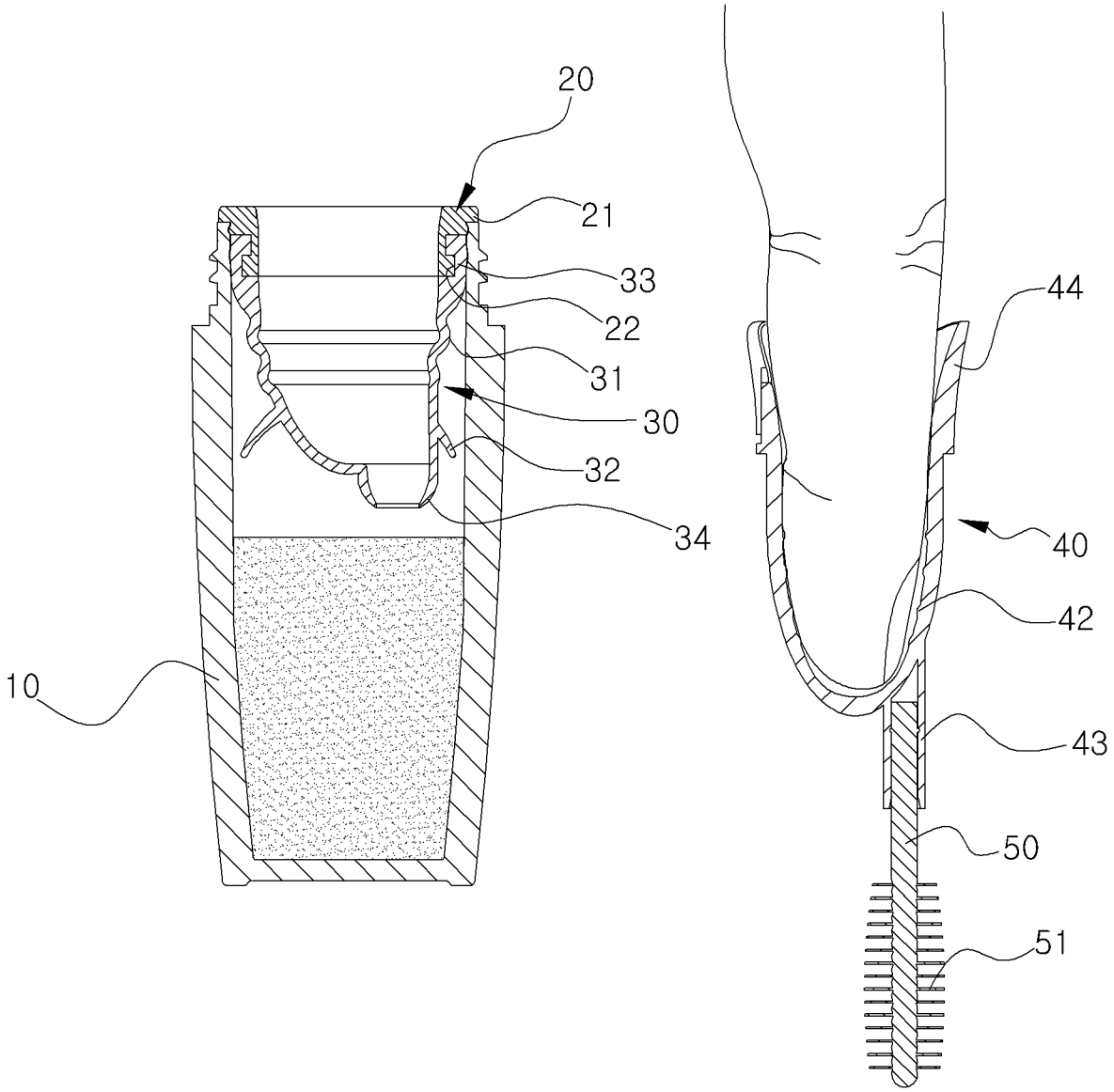
FIG. 8 is a sectional view showing a state of having separated a finger insertion member by inserting a finger into a finger-insertion mascara container having an eccentrically formed brush rod according to an embodiment of the present invention.

FIG. 3 is a perspective view showing a finger-insertion mascara container having an eccentrically formed brush rod according to an embodiment of the present invention. FIG. 4 is an exploded perspective view showing a finger-insertion mascara container having an eccentrically formed brush rod according to an embodiment of the present invention. FIG. 5 is a sectional view showing a finger-insertion mascara container having an eccentrically formed brush rod according to an embodiment of the present invention. FIG. 6 is a sectional view showing a state of separating a container lid of a finger-insertion mascara container having an eccentrically formed brush rod according to an embodiment of the present invention. FIG. 7 is a sectional view showing a state of separating a finger insertion member by inserting a finger into a finger-insertion mascara container having an eccentrically formed brush rod according to an embodiment of the present invention. FIG. 8 is a sectional view showing a state of having separated a finger insertion member by inserting a finger into a finger-insertion mascara container having an eccentrically formed brush rod according to an embodiment of the present invention.

The finger-insertion mascara container having the eccentrically formed brush rod according to the present invention includes: a container body 10 accommodated therein with a mascara liquid and formed in an upper portion thereof with an opening 11; a wiper 30 mounted on the opening 11 of the container body 10 to sweep a cosmetic material, and formed in a lower side thereof with an eccentric brush rod insertion hole 34; a finger insertion member 40 inserted into the wiper 30, formed therein with a finger insertion space 41, and provided at a lower side thereof with an eccentric brush rod coupling part 43; a brush rod 50 coupled to the eccentric brush rod coupling part 43 of the finger insertion member 40, and provided on a lower side thereof with a mascara brush 51.

The container body 10 is accommodated therein with a mascara liquid and formed at an upper end thereof with an opening part 11.

The wiper 30 may be mounted on the opening 11 of the container body 10 directly, or mounted after being coupled to a packing 20.

The packing 20 may prevent the wiper 30 from being separated from the container body 10, and preferably be formed of polypropylene (PP) or polyethylene (PE).

The packing 20 is formed on an upper end thereof with a latching sill 21, and formed on a lower outer peripheral surface thereof with a fastening protrusion wheel 22.

The latching sill 21 is latched to the opening 11 of the container body 10, thereby preventing the packing 20 from entering the inside of the container body 10.

The wiper 30 is coupled to the fastening protrusion wheel 22, and the wiper 30 is fitted between the fastening protrusion wheel 22 of the packing 20 and an inner wall of the container body 10.

The wiper 30 is coupled to the opening 11 of the container body 10 or the fastening protrusion wheel 22 of the packing 20, thereby sweeping the mascara liquid put on the brush rod.

The wiper (30) is formed of an elastic material so as to be elastically stretched and recovered, preferably formed of at least one material selected from natural rubber, elastomer, urethane rubber, nitrile-butadiene rubber (NBR), and silicone.

The wiper 30 is formed on an outer peripheral surface thereof with corrugated tube 31, and a counter-flow prevention protrusion wheel 32 is formed below the corrugated tube 31.

The wiper 30 is formed on an upper inner peripheral surface thereof with a fastening annular groove 33, and formed in a lower side thereof with an eccentric brush rod insertion hole 34.

The corrugated tube 31 is formed on the outer peripheral surface of the wiper 30 and elastically stretched, thereby enabling the brush 51 to put the mascara liquid remaining at a lower portion of the container body 10 thereon for use, so that the mascara liquid can be prevented from being remaining in the container body 10.

The counter-flow prevention protrusion wheel 32 is formed below the corrugated tube 31.

The counter-flow prevention protrusion wheel 32, as shown in FIG. 7, the mascara liquid put on the brush rod 50 is prevented from moving up along the outer peripheral surface of the wiper 30 when the finger insertion member 40 is separated from the container body 10, thereby preventing the mascara liquid from being hardened by entering a space between the wiper 30 and an inner wall of the container body 10.

The fastening protrusion wheel 22 of the packing 20 is coupled to the fastening annular groove 33 formed on the upper inner peripheral surface of the wiper 30, thereby preventing the wiper 30 from being dropped into the inside of the container body 10.

The wiper 30 is formed in a lower side thereof with an eccentric brush rod insertion hole 34 which is biased from the center of the wiper 30.

An eccentric brush rod coupling part 43 formed at the lower side of the finger insertion member 40 while being biased in one direction is inserted into the eccentric brush rod insertion hole 34.

The finger insertion member 40 is inserted into the wiper 30.

The finger insertion member 40 is formed therein with a finger insertion space 41, and provided at a lower side thereof with an eccentric brush rod coupling part 43 which is biased in one direction.

A finger is inserted into the finger insertion space 41, and an anti-slip protrusion 42 is formed on an inner peripheral surface to prevent the finger from slipping when the finger is inserted.

The finger insertion space 41 is used by inserting the finger into the finger insertion space 41 when the user puts makeup on eyelashes, thereby enabling the user to put makeup without holding the container lid 60, and preventing the user from carelessly dropping the finger insertion member 40 and contaminating the brush 51 coupled to the finger insertion member 40.

The eccentric brush rod coupling part 43 is coupled to the brush rod having the brush 51.

The brush rod 50 may be coupled to the eccentric brush rod coupling part 43, or may be integrally formed with the finger insertion member 40.

As for the brush rod 50 coupled to the eccentric brush rod coupling part 43, the user takes out the finger insertion member 40 by inserting the finger into the finger insertion space 41 to put makeup on the eyelashes by using the brush 51 of the eccentrically formed brush rod 50, thereby preventing the mascara brush rod from coming into contact with the face and disturbing makeup, as in the related art, and preventing the mascara liquid on the brush rod from staining on a side of an eye or on a nose.

A finger retaining portion 44 extends from an upper portion of the finger insertion member 40, and the finger retaining portion 44 serves to fix the finger inserted into the finger insertion space 41.

A plurality of elastic slit portions 45 are formed in the middle of the finger retaining portion 44.

As for the elastic slit portions 45, the finger retaining portion 44 is elastically opened when fingers of users having fingers different in thickness from each other are inserted into the finger insertion space 41, so that the insertion is easily performed regardless of the thickness of the finger, and the finger retaining portion 44, which is opened when the finger is inserted, is elastically returned and fixes the finger, so that the user can elaborately put makeup on the eyelashes without shaking upon makeup.

A container lid 60 is further coupled to the upper portion of the container body 10.

The container lid 60 is formed on an inner upper portion thereof with a plurality of pressing protrusion wheels 61.

As shown in FIG. 5, the pressing protrusion wheel 61 presses the finger retaining portion 44 of the finger insertion member 40 when the container lid 60 is closed.

The pressing protrusion wheel 61 presses an upper end of the finger retaining portion 44, and the wiper 30 is simultaneously pushed to the lower portion of the container body 10, so that the corrugated tube 31 is stretched, thus the finger insertion member 40 comes into close contact with the inside of the wiper 30, thereby sealing the container body 10, and thereby preventing the mascara liquid accommodated in the container body 10 from being volatilized.

An assembling method and a using state of the finger-insertion mascara container having the eccentrically formed brush rod according to the embodiment of the present invention will be described in detail as below.

According to the present invention, the packing 20 is coupled to the opening 11 at the upper portion of the container body 10, in which the wiper 30 is coupled to a lower portion of the packing 20 by fitting the fastening protrusion wheel 22 formed at the lower portion of the packing 20 into the fastening annular groove 33 of the wiper 30.

Then, the finger insertion member 40 is inserted into the wiper 30, and the eccentric brush rod coupling part 43 is coupled to the brush rod formed thereon with the brush 51.

In addition, the container lid 60 is coupled to the upper portion of the container body 10, in which the container lid 60 is formed on the inner upper portion thereof with the pressing protrusion wheel 61. As shown in FIG. 5, the pressing protrusion wheel 61 presses the finger retaining portion 44 of the finger insertion member 40 when the container lid 60 is closed, thus the assembly is finished.

In order to use the mascara liquid of the finger-insertion mascara container having the eccentrically formed brush rod assembled according to the above method, as shown in FIG. 6, the container lid 60 is opened from the container body 10.

At this point, the corrugated tube 31 of the wiper 30, which has been stretched by the pressure of the container lid 60, is contracted, thus the finger insertion member 40 moves upward.

Then, as shown in FIG. 7, the finger is inserted into the finger insertion space 41 of the finger insertion member 40, in which the finger retaining portion 44 extends from the upper portion of the finger insertion member 40, and a plurality of elastic slit portions 45 are formed in the middle of the finger retaining portion 44.

The finger retaining portion 44 is elastically opened due to the elastic slit portions 45, thus the insertion is easily performed regardless of the thickness of the finger when fingers of users having fingers different in thickness from each other are inserted into the finger insertion space 41, the finger retaining portion 44, which is opened when the finger is inserted, is elastically returned and fix the finger, so that the user can elaborately put makeup on the eyelashes without shaking upon makeup.

Then, as shown in FIG. 8, the finger insertion member 40 is detached from the container body 10.

As for the brush rod 50 coupled to the eccentric brush rod coupling part 43, the user takes out the finger insertion member 40 by inserting the finger into the finger insertion space 41 to put makeup on the eyelashes by using the brush 51 of the eccentrically formed brush rod 50, thereby preventing the mascara brush rod from coming into contact with the face and disturbing makeup, as in the prior art, and preventing the mascara liquid on the brush rod from staining on a side of an eye or on a nose.

The above description of the present invention is merely an embodiment for implementing the finger-insertion mascara container having the eccentrically formed brush rod, and the present invention is not limited to the embodiment. Preferred embodiments have been proposed and set forth in the aforementioned description, however it will be apparent to those having ordinary skill in the art in that many different substitutions, deformations and modifications are available within the scope without departing from the invention.

[Description of Reference Numerals]

| | |
|---|---|
| 10: container body | 11: opening |
| 20: packing | 21: latching sill |
| 22: fastening protrusion wheel | 30: wiper |
| 31: corrugated tube | |
| 32: counter-flow prevention protrusion wheel | |
| 33: fastening annular groove | |
| 34: eccentric brush rod insertion hole | |
| 40: finger insertion member | 41: finger insertion space |
| 42: anti-slip protrusion | |
| 43: eccentric brush rod coupling part | |
| 44: finger retaining portion | 45: elastic slit portion |
| 50: brush rod | 51: brush |
| 60: case lid | 61: pressing protrusion wheel |

The invention claimed is:

1. A finger-insertion mascara, container having an eccentrically formed brush rod, the finger-insertion mascara container comprising:

a container body (10) formed in an upper portion thereof with an opening (11) and accommodated therein with a mascara liquid;

a wiper (30) formed in a lower side thereof with an eccentric brush rod insertion hole (34) and mounted on the opening (11) of the container body (10) to sweep the cosmetic liquid;

finger insertion member (40) inserted into the wiper (30), formed therein with a finger insertion space (41), and provided at a lower side thereof with an eccentric brush rod coupling part (43); and a brush rod (50) coupled to the eccentric brush rod coupling part (43) of the finger insertion member (40), and Provided on a lower side thereof with a mascara brush (51), wherein the eccentric brush rod insertion hole (34) is formed in the lower side of the wiper (30) while being biased in one direction, and the eccentric brush rod coupling part (43) is formed at the lower side of the finger insertion member (40) while being biased in one direction so as to be inserted into the eccentric brush rod insertion hole (34).

2. The finger-insertion mascara container of claim 1, wherein a packing (20) is further coupled between the opening (11) of the container body (10) and the wiper (30).

3. The finger-insertion mascara container of claim 1, wherein the wiper (30) is provided on an outer peripheral surface thereof with a corrugated tube (31).

4. The finger-insertion mascara container of claim 1, wherein the wiper (30) is formed on a lower outer peripheral surface thereof with a counter-flow prevention protrusion wheel (32) for preventing a counter-flow of the mascara liquid.

5. The finger-insertion mascara container of claim 1, wherein the finger insertion member (40) is provided on an inner peripheral surface thereof with an anti-slip protrusion (42).

6. The finger-insertion mascara container of claim 1, wherein a finger, retaining portion (44) extends from an upper part finger insertion member (40), and an elastic slit portion (45) is formed in a middle the finger retaining portion (44).

7. The finger-insertion mascara container of claim 1, further comprising a container lid (60) coupled to the upper portion of the container body (10).

8. A finger-insertion mascara container having an eccentrically formed brush rod, the finger-insertion mascara container comprising a container body (10) formed in an upper Portion thereof with an opening (11), and accommodated therein with a mascara liquid;

a wiper (30) mounted on the opening (11) of the container body (10) to sweep a cosmetic Material, and formed in a lower side thereof with an eccentric brush rod insertion hole (34);

a finger insertion member (40) inserted into the wiper (30), formed therein with a finger insertion space (41), provided at a lower side thereof with a brush rod (50) having an end portion provided with a mascara brush (51), wherein the eccentric brush rod insertion hole (34) is formed in the lower side of the wiper (30) while being biased in one direction, and the brush rod (50) is integrally formed at a lower side Of a finger insertion member (40) while being biased in one direction so as to be inserted into the eccentric brush rod insertion hole (34).

9. The finger-insertion mascara container of claim 8, wherein a packing (20) is further coupled between the opening (11) the container body (10) and the wiper (30).

10. The finger-insertion mascara container of claim 8, wherein the wiper (30) is provided on an outer peripheral surface thereof with a corrugated tube (31).

11. The finger-insertion mascara container of claim 8, wherein the wiper (30) is formed on a lower outer peripheral surface thereof with a counter-flow prevention protrusion wheel (32) for preventing a counter-flow of the mascara liquid.

12. The finger-insertion mascara container of claim 8, wherein the finger insertion member (40) is provided on an inner peripheral surface thereof with an anti-slip protrusion (42).

13. The finger-insertion mascara container of claim 8, wherein a finger retaining portion (44) extends from an upper part of the finger insertion member (40), and an elastic slit portion (45) is formed in, a middle of the finger retaining portion (44).

14. The finger-insertion mascara container of claim 8, further comprising a container lid (60) coupled to the upper portion of the container body (10).

15. The finger-insertion mascara container of claim 14, wherein the container lid (60) is formed on an inner surface thereof with a pressing protrusion wheel (61).

* * * * *